US005630747A

United States Patent [19]

Haller

[11] Patent Number: 5,630,747

[45] Date of Patent: May 20, 1997

[54] GRINDING MACHINE FOR SHARPENING TOOLS

[75] Inventor: Hubert Haller, Trossingen, Germany

[73] Assignee: Hawema Werkzeugschleifmaschinen GmbH, Germany

[21] Appl. No.: 524,372

[22] Filed: Sep. 6, 1995

[30] Foreign Application Priority Data

Sep. 6, 1994 [DE] Germany ..... 44 31 634.8

[51] Int. Cl.[6] ..... B24B 49/00

[52] U.S. Cl. ..... 451/11; 451/10; 451/242; 451/246

[58] Field of Search ..... 451/10, 11, 242, 451/246, 375, 376, 48, 220, 222

[56] References Cited

U.S. PATENT DOCUMENTS

| | | | |
|---|---|---|---|
| 2,458,840 | 1/1949 | Eklund . | |
| 3,626,436 | 12/1971 | Lhomme | 451/375 |
| 3,680,263 | 8/1972 | Johnson | 451/48 |
| 4,833,764 | 5/1989 | Müller | 451/11 |
| 5,168,661 | 12/1992 | Pederson et al. | 451/11 |
| 5,197,228 | 3/1993 | Sharkey, III et al. | 451/11 |
| 5,359,814 | 11/1994 | Baltazar et al. | 451/11 |
| 5,462,470 | 10/1995 | Oda et al. | 451/11 |
| 5,503,588 | 4/1996 | Sweet | 451/10 |

FOREIGN PATENT DOCUMENTS

| | | | |
|---|---|---|---|
| 2647360A1 | 4/1978 | Germany | B24B 3/02 |

*Primary Examiner*—James G. Smith
*Assistant Examiner*—Dona C. Edwards
*Attorney, Agent, or Firm*—Dominik & Stein

[57] ABSTRACT

Tool grinding machine with a, from the machine stand (2) carried and horizontally oriented work platform (10), a work piece (200) receiving and upon the work platform (10) seated work piece carrier (20), as well as a grinder tool (300) receiving grinder head (30), which is mounted on a grinder upright support (32), which is oriented vertically and which is rotatable about a vertically extending axis via a rotating disk (36), wherein the rotating disk (36) is provided below the work platform (10) and integrated in the machine stand (2), and a carrier arm (34) is provided for the grinder upright support (32), which at one end is rigidly attached to the rotating disk (36) and at the other end extends sideways beyond the work platform (10), in such a manner that the thereupon provided grinder upright support (32) is rotatable around the work platform (10).

9 Claims, 2 Drawing Sheets

GRINDING MACHINE FOR SHARPENING TOOLS

BACKGROUND OF THE INVENTION

1. Field of the Invention

The invention concerns a tool grinding machine wherein an adjustable grinder is rotatably mounted on a work platform.

2. Description of the Related Art

This type of tool grinding machine has in principle been known for a long time and serves particularly for the restoration of cutting tools, that is, for the resharpening of the cutting edges, whereby the cutting geometry as such is reconstructed to the greatest extent possible. As cutting tools to be considered within the meaning of the type discussed above not only special tools with specialized cutting geometries, but rather also standard tools in the form of milling cutters, augers, and chamfering drills.

For the most part this type of tool grinding machine is built into a machine stand, on which are mounted various tools necessary for a particular function. For this there is employed first the horizontally oriented work platform, which as a rule is dimensioned to a high precision and which provides mounting opportunities, in particular in the form of grooves, for further subassemblies or subunits.

On the work platform there is provided a tool holder, which receives the tool to be worked upon. The tool holder is provided with, for example, a longitudinal and a transverse support, which provide for rapid adjustment in the longitudinal as well as in the transverse directions. Further, the tool spindle is itself, or coupled together with the longitudinal support, rotatably moveable, so that various combinations of a turning and a slidable displacement are possible.

The processing of the tool is accomplished via a grinder, for example via a grinder disk, which is removably fixed to a grinder head. Depending upon the requirements, the grinder head is pivotable about various axis, so that the desired contour pattern can be followed. For this the grinder head is mounted in a vertical oriented and with a height position adjustable grinder upright support, whereby the grinder upright support for its part is mounted to be rotatable about a vertical extending axis on a rotating disk. The rotating disk is likewise mounted upon the working platform, and more specifically adjacent the tool holder in such a manner, that the grinding disk can be directed at the tool. One such tool grinding machine, over which the present invention represents an improvement, is for example illustrated in the pamphlet of the Christien AG, Wabern-Bern, Switzerland "Christen Tool Grinding Machines, AU-150 Universal Tool Grinding Machine" at pages 4–7.

Although such tool grinding machines have in practice been found useful, they do exhibit a number of deficiencies. In particular the high space requirement for the grinder upright support including the turning disk upon which it is mounted severely restricts the available work space, so that it is as a rule necessary to use a machine stand with a greater work platform area. This not only increases the requirement for floor space, but rather also substantially raises the price of a tool grinding machine of this type. Further disadvantages result therefrom, that the rotating disk must unavoidably lie underneath the actual work zone, and that it is thus is subject to an increased likelihood of soiling and damage due to falling debris and grinder particles and the like. Numerous special protective coverings have been devised, which however hinder the ability to access and manipulate.

The invention is thus concerned with the problem of providing a tool grinding machine of the type discussed above which is however improved in the regard that it is no longer subject to the type of disadvantages mentioned above. In particular a class of tool grinding machine is to be developed, which is made as compact as possible and which enables an unrestricted accessability to the work area.

SUMMARY OF THE INVENTION

The invention is based upon the idea, that the rotating disk with its thereupon mounted grinding upright support is no longer situated upon the work platform, but rather lies underneath integrated into the machine stand. In general there is adequate space underneath the work platform for the installation of the rotating disk without any problems. In order to enable a further rotation ability of the grinder head the grinder head upright support is connected to a carrier arm, which at one end is connected to the rotating disk, and which on the other side extends sideways out of the machine stand, in order to receive the grinder upright support. According to this the grinder upright support is mounted outside of the work platform, whereby access to the work area is optimal, that is, unimpeded from all sides. The machine stand can be constructed compactly and with savings in space, whereby a substantial cost advantage can be realized as compared to an embodiment according to the conventional design. Ergonomic advantages follow as a result of the unimpeded access to the work area, so that also a more rapid work piece or tool change out is made possible. Further, the soiling of the rotating disk by falling grinder particles or the like is prevented, since the rotating disk is mounted underneath the work platform, and is thereby protected from the falling grinder particles.

Further it is now as before possible to so position the grinding machine, that the grinder or, as the case may be, processing point, lies exactly at the turning point, that is, the rotation axis, of the rotating disk. Therewith it becomes possible to grind radiuses, including full radiuses, without any problem. Beginning from the position at which the grinding disk is directed at the longitudinal axis (rotation axis) of the work piece, a circular arc shaped rotation movement towards both sides can be accomplished.

Preferably the rotating disk is double mounted, whereby an until now unachievable stability can be achieved. In reality this is achieved by a mounting shaft which passes centrally through the rotating disk and which projects above and below beyond it. On the respective projecting mounts are provided, which support themselves within the machine stand and/or underneath on the work platform. This type of mounting substantially increases the load bearing capacity of the rotating disk as compared to the until now conventional one-sided mounting arrangements, whereby the precision is also increased. In particular the grinder support column can also be made more stable and/or additional subassemblies can be provided, such as motors for raising or lowering the grinder head.

Preferred as mounts are roller bearings, in particular ball bearing mounts, which are capable of receiving the axial and radial loads which will occur and yet have only minimal requirement of space occupancy.

Preferably the grinder support column, and therewith the grinder head, is rotatable in a rotation arc greater than 180°, preferably about 190°, so that complicated contours can also be followed.

For ease of adjusting an register shaft is provided, which is positionable in an exactly defined position coaxially with the rotation axis of the rotating disk on the work platform. Thereby the grinding disk can be placed with great precision at the rotation point.

BRIEF DESCRIPTION OF THE DRAWINGS

The invention will now be described by reference to the schematically represented illustrative embodiment. There is shown.

DETAILED DESCRIPTION OF THE INVENTION

Figure 1:
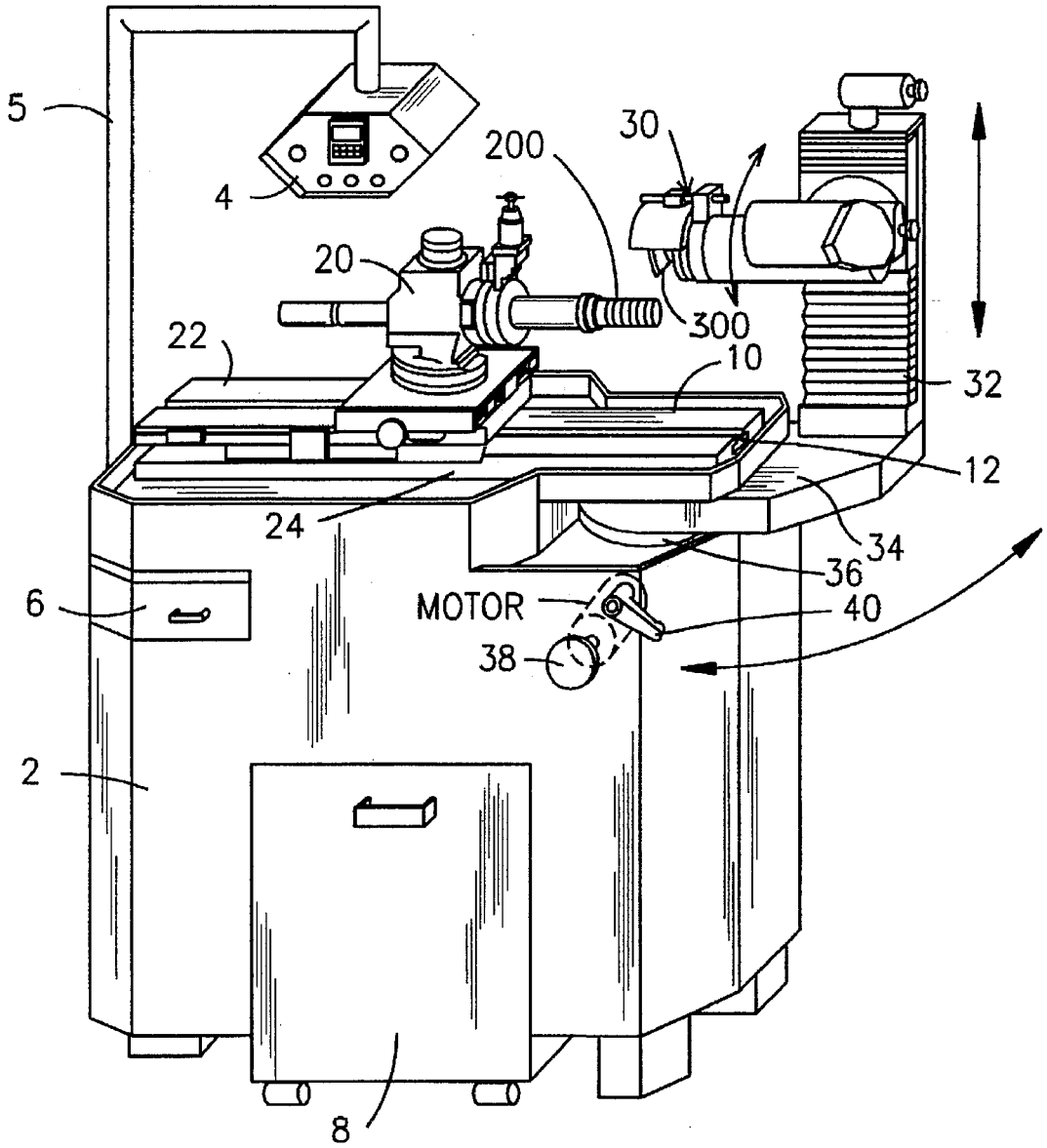
FIG. 1 perspective view of the tool grinding machine

The tool grinding machine includes a machine stand 2 of a known design, in which are incorporated various construction elements or subassemblies including a cooling system 8 and a tool receiver 6. The machine stand 2 supports a work platform 10, which is oriented horizontally and which is provided with a highly precise and planar milled upper surface. The work platform 10 extends substantially over the entire length of the machine stand 2 and is constructed symmetric with respect to the longitudinally transecting notch 12. The notch 12 serves for the securing of a cross sled comprised of a longitudinal support 22 and a transverse support, which receives a work piece carrier 20. The work piece carrier can thus be directed longitudinally as well as transversely. The work piece carrier 20 receives a work piece 200 to be worked upon, which can be for example a milling cutter, of which the cutting edges require resharpening.

For this the grinder head 30 is provided, which is mounted on a grinder upright support in such a conventional manner as to be height adjustable. The grinder upright support extends vertically from one end of the carrier arm 34. The opposite end of the carrier arm is nonrotatingly secured to a rotating disk 36, which is rotatably mounted underneath the work platform 10 in the machine stand 2 in a manner discussed in greater detail below. Thereby the grinder upright support 32—and with it the grinder head 30—can be pivoted about a vertical axis. The construction of the rotating disk 36 is so selected, that the rotational axis transects the symmetrical axis (vertical) of the work platform 10. Therewith the cutting disk 300, which is capable of being mounted on the grinder head 30, can be placed exactly in the center of rotation and, with respect to the work piece to be processed 200 can be provided centrally. As a result of this central locating a rotating can be carried out in both directions, in particular makes possible a working of radiuses in the front sides of the work piece 200.

The length of the carrier arm 34 is so dimensioned, that it extends beyond the machine stand to such an extent, that the above-discussed pivoting movement can be accomplished without impedance. The machine stand 2 is also so constructed in the pivot area of the carrier arm 34 that the travel beginning from the above-described central position of the grinder head 30 or as the case may be the grinder upright support 32 is pivotable to describe an arc in both directions of somewhat more than 90°, and therewith a total arc of more than 180°. In the present illustrative embodiment the pivot arc describes about 190° and therewith makes possible an optimal accessability to the work piece 200. The accessability is, when compared to the conventional tool grinding machines, greatly improved thereby, that the work area, which extend from the bottom side of the work piece 200 to the upper surface of the work platform 10, is completely undisturbed by any construction elements, and thus in principal also makes possible a working from underneath. In particular the adjustment and alignment is made particularly simple and reduces thereby the work stoppage time of the machine.

Grinder particles, work piece tailings, or the like can not enter into the vicinity of the mounting of the rotating disk 36 as a result of this configuration, so that no danger of any type of soiling or damage exists. Rather, the grinder particles and work piece tailings can be removed without any difficulty from the work platform 10, and thus no special cover is required in this area.

Figure 2:
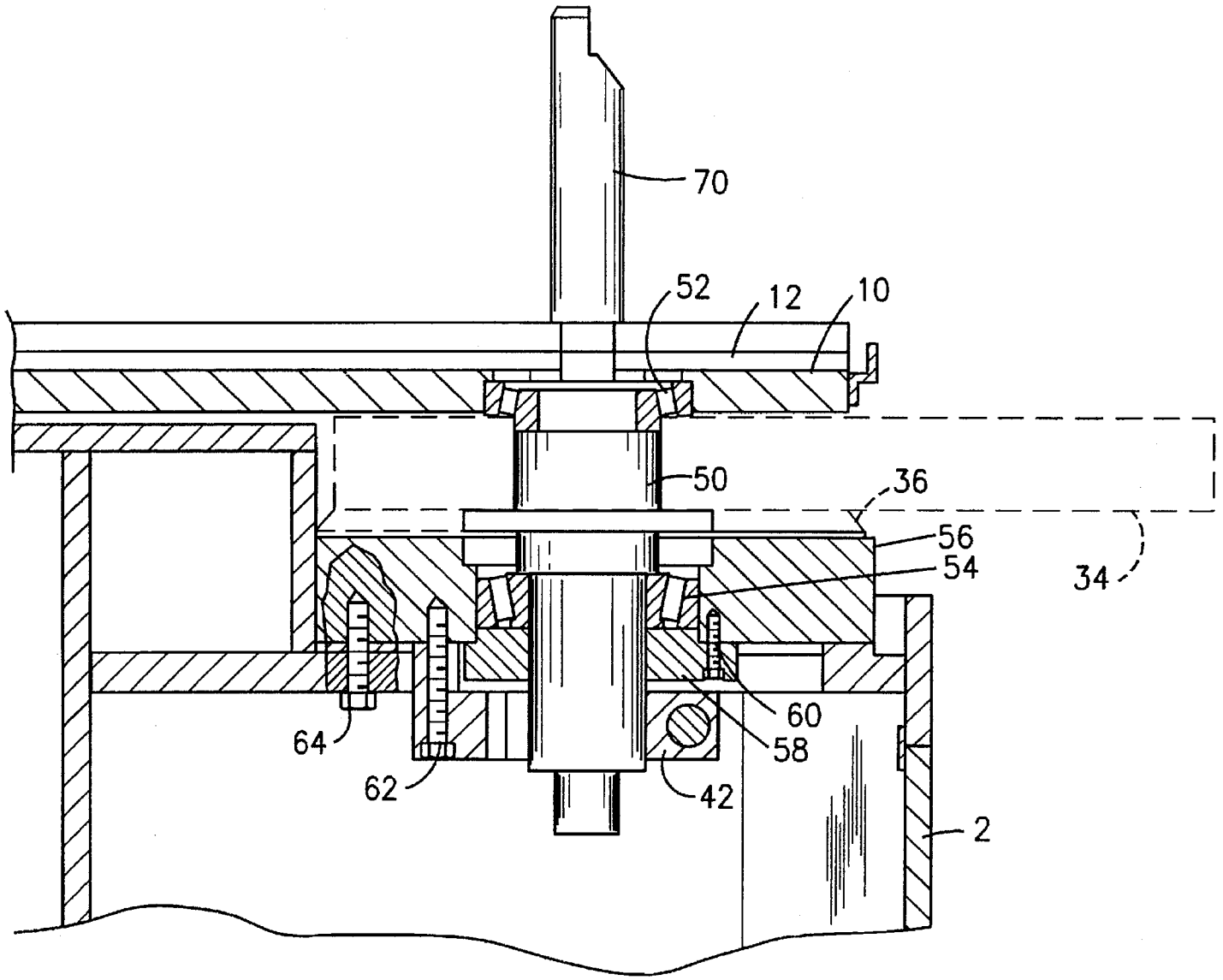
FIG. 2 enlarged cross sectional representation of the mounting of the rotating disk

The rotating disk 36 is operable via a hand wheel 38. A not shown mechanism permits the exact positioning in the desired angular relationship, in which the rotating disk 36 is fixable in a known manner via a clamping means 42 (FIG. 2). The clamping means 42 is easily operated by means of a clamp handle 40.

The various above-described movements inclusive of the adjustment movements can be controlled not only manually but also partially or fully automatically. For this there are provided motors, which bring about the pivot movement of the rotating disk 36 or the height adjustment of the grinder head 30.

On the side of the machine stand 2 a gallows 5 is provided, on to which the operating input panel 4 for programming of the controller is provided. Depending upon the type of construction a CNC-machine can be constructed using simple, cost effective construction components.

In FIG. 2 a preferred mounting of the rotating disk 36 is shown. There is shown a dual mount, in which the rotating disk is supported in both directions, that is, from above and from below. For this a step-type mounting shaft 50 is provided, which fixedly and non-rotatingly bears the rotating disk 36 inclusive of the carrier arm 34. The mounting shaft 50 projects upwards above the carrier arm 34 and bears on its end roller ball bearing assembly 52. On the other side the roller ball bearing assembly 52 is seated in the work platform 10.

Below the rotating disk 36 a further roller ball bearing assembly 54 is provided, which is seated on the opposite side in the radial direction in a base plate 56, which is provided on the machine stand 2. In the axial direction the roller ball bearing assembly 54 is held by a guide ring, which is seated axially from below on the base plate 56 and which is fixed via a screw 60.

By using the two roller ball bearings 52, 54 a particularly simple and space saving construction of the dual mounting for the rotating disk 34 and the pivot arm 34 is made possible. This simplifies its integration into the machine stand 2, and achieves at the same time an until now not achieved stability, even in the case of heavy loading.

For the fixing at a certain desired angular relationship of the rotating disk 36 a clamping means 42 is provided, which is provided on the base plate 56 by means of a screw 62 and is in operational association with the mounting shaft 50. The operation thereof is accomplished in a known manner by means of a clamp handle 40. Likewise, not shown in any great detail, a hand wheel 38 can produce a fine adjustment of the position of the tilt angle.

The cross sectional representation shown in FIG. 2 shows that the mounting shaft 50 is positioned with its rotational axis exactly in the cutting plane which runs through the longitudinal axis of the work platform 10. In coaxial orientation to the mounting shaft 50 there is thus a register shaft 70 inserted in the work platform 10, of which the position is known to be highly precise and which serves to align the cutting disk 300.

The above described illustrative embodiment serves only to help visualize the principle of the mounting of a rotating disk underneath the work platform, which is in like manner to be utilized in other tool machines. It is of little consequence whether the machine is manual, semiautomatic, or fully automatic, so that in particular any of a wide variety of tool carriers can utilize the invention.

I claim:

1. Tool grinding machine comprising a machine stand, a horizontally oriented work platform supported by said machine stand, a carrier for receiving a work piece, said carrier mounted upon said work platform, a rotating disk (36) mounted below said work platform (10) and integrated in said machine stand (2), said rotating disk (36) mounted on a mounting shaft (50) which extends centrally through said rotating disk (36) and extends out above and below said rotating disk (36), and which mounting shaft (50) is restrained by bearings (52, 54) provided both above and below the rotating disk (36), a carrier arm (34) having a first end and a second end, said first end fixedly coupled to said rotating disk (36), said second end extending sideways beyond the work platform (10), a grinder upright support (32) oriented vertically and mounted on said second end of said carrier arm (34) such that said upright grinder support (32) is rotatable about a vertically extending axis via said rotating disk and is thereby rotatable around the work platform (10), and a grinder head for receiving a grinder disk, said grinder head mounted upon said grinder upright support.

2. Tool grinding machine according to claim 1, wherein the bearings (52, 54) are roller bearings.

3. Tool grinding machine according to claim 2, wherein the bearings (52, 54) are roller ball bearings.

4. Tool grinding machine according to claim 1, including a clamping means (42) for securing of the rotating disk (36).

5. Tool grinding machine according to claim 1, wherein the rotating disk (36) provides for a rotation ark of at least somewhat more than 180°.

6. Tool grinding machine according to claim 5, wherein said arc of rotation is approximately 190°.

7. Tool grinding machine according to claim 1, wherein the axis of rotation of the rotating disk (36) transects the longitudinal axis of the work platform (10).

8. Tool grinding machine according to claim 7, including a register shaft (70) capable of being inserted on the work platform (10).

9. Tool grinding machine according to claim 1, wherein the rotating disk (36) is motor driven.

* * * * *